United States Patent [19]

Kumada

[11] Patent Number: 4,471,258

[45] Date of Patent: Sep. 11, 1984

[54] PIEZOELECTRIC CERAMIC TRANSDUCER

[75] Inventor: Akio Kumada, Kokubunji, Japan

[73] Assignee: Hitachi, Ltd., Tokyo, Japan

[21] Appl. No.: 319,312

[22] Filed: Nov. 9, 1981

[30] Foreign Application Priority Data

Nov. 7, 1980 [JP] Japan ..... 55-155906
Jun. 3, 1981 [JP] Japan ..... 56-81005[U]

[51] Int. Cl.[3] ..... H04R 17/00

[52] U.S. Cl. ..... 310/345; 310/348; 368/255

[58] Field of Search ..... 310/322, 324, 330, 345, 310/348, 358; 368/255

[56] References Cited

U.S. PATENT DOCUMENTS

| | | | |
|---|---|---|---|
| 3,123,727 | 3/1964 | Kritz | 310/331 |
| 3,370,187 | 2/1968 | Straube | 310/330 |
| 3,588,552 | 6/1971 | Schafft | 310/334 |
| 3,708,702 | 1/1973 | Brunnert et al. | 310/345 X |
| 3,721,840 | 3/1973 | Yamada | 310/345 X |
| 4,352,961 | 10/1982 | Kumada et al. | 368/255 X |

FOREIGN PATENT DOCUMENTS

| | | | |
|---|---|---|---|
| 1127950 | 4/1962 | Fed. Rep. of Germany . | |
| 99089 | 7/1980 | Japan | 368/255 |

*Primary Examiner*—Peter S. Wong
*Attorney, Agent, or Firm*—Antonelli, Terry & Wands

[57] ABSTRACT

In a transducer including at least a piezoelectric ceramic plate which has curved surfaces, electrodes which are formed on both the main surfaces of the piezoelectric ceramic plate, a frame which holds the piezoelectric ceramic plate, and means for applying an electric signal to the electrodes; this invention is characterized in that the holding frame is made of an organic high-polymer resin. Since the piezoelectric ceramic plate has the curved surfaces and the holding frame is made of the organic high-polymer resin, the transducer is suitable as a loudspeaker for audio use having a wide frequency band.

21 Claims, 24 Drawing Figures

PIEZOELECTRIC CERAMIC TRANSDUCER

BACKGROUND OF THE INVENTION

1. Field of the Invention

This invention relates to a flat transducer which employs a thin plate of a piezoelectric substance. It is useful for audio microphones or loudspeakers, etc.

2. Description of the Prior Art

Recently, technologies for miniaturizing radios, tape recorders etc. and operating them with the battery drive for long periods of time have progressed, and the thin pocketable type has come into fashion. This tendency owes much to the advance of the circuit integration technology especially having supported the spread of pocketable type electronic desk calculators. The electronic desk calculators have also been equipped with small-sized sound producers developed for the alarms of wrist watches, and the input/output operations of calculations have utilized, not only display to the eyes, but also audio signals to the ears.

Now, a battery-driven electronic micro-device such as watch, calculator, radio and tape recorder trends to be provided with both a display and a sound producer and/or microphone. In this case, the display has been rendered small in size, flat in structure and low in power dissipation owing to the advent of liquid crystal. Regarding the sound producer, however, any product does not fully satisfy the requisites of a small size, a thin structure and a low power dissipation. Therefore, the need for a flat speaker has risen abruptly, and the development thereof has become the technological subject of the times.

As stated before, the sound producer required for the electronic micro-device must be small in size, flat in structure and low in power dissipation. Although a piezoelectric buzzer is excellent in points of the small size, the flat structure and the low power dissipation, it is a resonator for a signal of fixed frequency. It cannot cover a desired acoustic band as the speaker for audio signals of wide frequency band, and is very difficult to produce clear voices.

An example of the piezoelectric buzzer for watches is known from Japanese Patent Application Laid-open Specification No. 55171/1978.

SUMMARY OF THE INVENTION

This invention consists in a transducer having at least a piezoelectric ceramic plate with curved surfaces, electrodes formed on both the main surfaces of the piezoelectric ceramic plate, a frame for holding the piezoelectric ceramic plate, and means for applying an electric signal across the electrodes, characterized in that the holding frame is formed of an organic high-polymer resin or the like. Since the piezoelectric ceramic plate has the curved surfaces and the holding frame is made of the organic high-polymer resin or the like, the transducer is suitable as a speaker for audio signals having a wide frequency band.

DETAILED DESCRIPTION OF THE INVENTION

Figure 1:
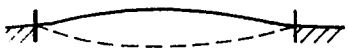
PRIOR ART FIG. 1
FIGS. 1 and 2 are model diagrams for explaining prior-art transducers.

In a prior-art piezoelectric ceramic transducer employing a piezoelectric material which is provided with electrodes on both its main surfaces, when an A.C. signal is applied to the flat plate, a vibration is caused within the plane of the flat plate by the piezoelectric effect. Since this vibration is a vibration in the mode in which the plane expands and contracts, it is unfavorable for the acoustic output of vibrating the air. In order to produce the acoustic output by vibrating the flat plate, a vibration must be excited in the bending mode in which the flat plate moves perpendicularly to its plane, that is, the plane itself moves in the normal direction thereof.

In general, the bending mode cannot be excited merely by applying an A.C. signal to a flat plate, but it can be readily excited with a bimorph structure. The bimorph, however, is a structure which includes two flat plates stuck together and in which the expansion and contraction of one plate within its plane is constrained by the other plate through the stuck surfaces, resulting in a bending motion. During the bending motion, accordingly, stresses develop in the stuck surfaces. These stresses can also be said the motive power of the bending motion.

As apparent from the above principle of the bending motion in the bimorph vibrator, the piezoelectric plates can no longer perform free deformations and can only perform deformations restrained by the stuck surfaces. For this reason, the efficiency of conversion from an electrical input into a mechanical vibration becomes half of that in the case where the free deformation is possible.

In contrast, according to this invention, as stated before, curved surfaces are formed by fitting a piezoelectric film in a holding plate, so that a vibrator capable of converting the expansion and contraction of the piezoelectric material within its plane into a bending motion in a form close to the free deformation can be provided.

Further, the holding frame is formed of a synthetic resin. This is favorable for acoustic use.

The radius of curvature of the piezoelectric material is made approximately 100–1,000 mm, more preferably approximately 150–400 mm.

According to this invention, the flat plate of the piezoelectric substance is curved in advance, and its peripheral part is fixed so as to stably hold the curved state. Since both the main surfaces of the piezoelectric flat plate are in the free states, they expand and contract substantially freely upon applying a voltage across electrodes disposed thereon. Since, however, the peripheral part of the plate is fixed so as to prevent the size from changing, a bending motion occurs. When the plate has expanded, the curve increases and the radius of curvature thereof decreases, whereas when the plate has contracted, the radius of curvature increases. Herein, the difference in the radius of curvature between both the surfaces increases with the magnitude of the curve and also increases with the thickness of the plate. When the bending vibration has occurred upon the application of the electric signal, the conversion efficiency of energy lowers in accordance with the difference between the variations of the radii of curvatures of both the surfaces of the plate. As the thickness of the piezoelectric plate is smaller and as the amplitude of the vibration is smaller, the aforecited conversion efficiency becomes higher and closer to the conversion efficiency in the free deformation.

The above is the principle of the operating mechanism of the piezoelectric transducer according to this invention as a loudspeaker, and it has been revealed that a thinner plate exhibits a higher electromechanical energy conversion efficiency. In case of the loudspeaker, the vibration is afforded to the air, so that the acoustic output is determined by the vibration area and amplitude and that a mechanical impedance such as the hardness of the vibrator plate is not an important problem.

On the other hand, in case of a microphone, since a vibrator plate needs to function to convert into an electric signal a sound pressure established by an air vibration, it must have a mechanical impedance low enough to respond to the vibration of the air. In case where the transducer operates in the bending mode, the vibrator plate must be thin and easy of bending as far as possible. The transducer of this invention has a higher conversion efficiency as it is thinner, and hence, it is also favorable for the use as the microphone.

Further, the transducer of this invention has the feature that it can be utilized at a high efficiency in practical use. In case of using the transducer as the loudspeaker or the microphone, the vibrator must be held by any method.

Figure 2:
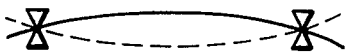
PRIOR ART FIG. 2

The vibrator in the bending mode is ordinarily held in its peripheral part. In the prior-art bimorph type, a metal sheet is usually sandwiched for reinforcement between the neutral surfaces, while in the unimorph type, a piezoelectric plate is usually stuck to a metal vibrator plate. In order to hold these vibrators, the so-called "peripheral fixation" holding system (FIG. 1) in which the peripheral part of the metal sheet or plate is fixed to a frame or the like is relied on. In holding the vibrator of the bending mode, the peripheral supporting system (FIG. 2) is higher in efficiency. Since, however, the holding with the peripheral supporting system is actually difficult, the metal sheet or plate is made larger than the piezoelectric plate and has its peripheral part fixed, so that the conversion efficiency of energy becomes still lower than its theoretical value.

Figure 3:
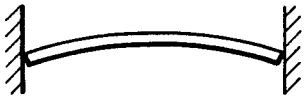
FIG. 3 is a model diagram for explaining a transducer of this invention.

On the other hand, in the transducer of this invention, the piezoelectric vibrator is held under the curved state in the smaller frame. Therefore, essentially the holding system of the peripheral support is adopted as shown in FIG. 3, and the structure is easy of attaining a conversion efficiency close to its theoretical value. This is also one of the important features of the invention.

In this manner, when the invention is applied to the transparent flat loudspeaker, voices in a sufficient volume can be secured and can be made clear in practical use. That is, the transparent flat loudspeaker has the following advantages: (1) Since the piezoelectric ceramic plate serves both as the vibrator and as the voice producing plate, it is dispensed with to stick the producing plate and the vibrator together. It has therefore become possible to prevent the lowering of the transparency due to a binder. It has also become possible to prevent the shortening of the lifetime ascribable to the secular degradation of the binder. (2) In general, a protective cover can be independently disposde in a manner to be separate from the transducer. This has made it possible to lower the mechanical impedance and to improve the low-pitched sound characteristic. (3) It has become possible to utilize the transducer, not only as the loudspeaker, but also as the microphone.

Thus, the transparent loudspeaker has been permitted to demonstrate the epoc-making advantages. That is, the practicable range of the ceramic transducer of this invention has extended much wider than that of the prior-art transparent flat sound producer which principally contains a transparent ceramic and whose structure is merely the prior-art bimorph buzzer with its frequency band widened.

FIGS. 4*a*–4*e* and FIGS. 5*a*–5*e* illustrate various methods of holding piezoelectric ceramic plates typically and the tendencies of the corresponding frequency characteristics of voices.

Figure 4A:
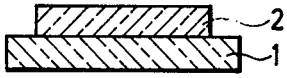
FIGS. 4*a* and 4*e* are views showing various methods of mounting piezoelectric ceramic plates.
Figure 5A:
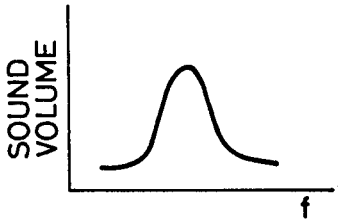
FIGS. 5*a* to 5*e* are graphs showing the frequency characteristics of various transducers.

In the method of FIG. 4*a*, a piezoelectric vibrator 2 is bonded on a flat plate 1. Although electrodes are disposed on both the main surfaces of the piezoelectric vibrator 2, they are omitted in the drawing. In this case, a sound is produced in such a way that the flat plate 1 is vibrated along with the piezoelectric vibrator 2. The frequency band of the sounds is narrow as illustrated in FIG. 5*a*. In addition, the sound volume is small. Such structure is usually used for buzzers, and is difficult of producing human voices etc.

Figure 4B:
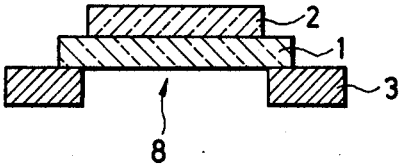
Figure 5B:
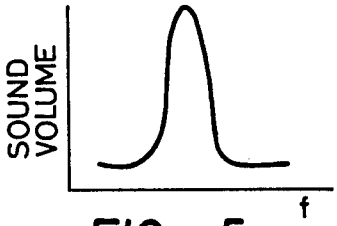

In the method of FIG. 4*b*, the transducer in FIG. 4*a* is mounted on a frame 3 which is provided with an opening 8. Since the flat plate 1 oscillates with a node at the contact portion between the frame 3 and the flat plate 1, the sound volume increases, but the frequency band does not essentially differ from that in the foregoing example. The sound volume and the frequency band are shown in FIG. 5*b*.

Figure 4C:
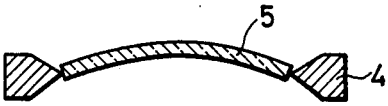
Figure 5C:
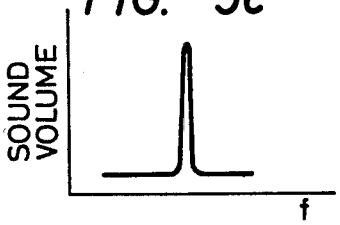

In the method of FIG. 4*c*, a curved type piezoelectric ceramic plate 5 is held in fitted engagement with the tip part of a metal frame 4. Since the plate 5 has its peripheral edge fixed by the metal or the like inelastic material, it vibrates perpendicularly to its plane very greatly. As shown in FIG. 5*c*, however, the frequency band is very narrow.

Figure 4D:
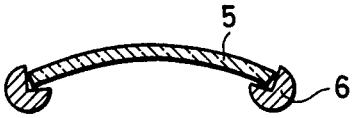
Figure 5D:
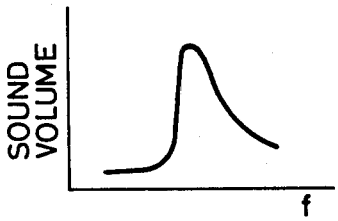

The method of FIG. 4*d* consists in that the curved type piezoelectric ceramic plate 5 is snugly fitted in a metal frame 6 which is slightly movable. Since the metal frame 6 moves slightly along with the plate 5, the frequency band becomes somewhat wide as shown in FIG. 5*d*, but it is unsatisfactory for producing voices.

Figure 4E:
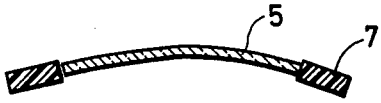
Figure 5E:
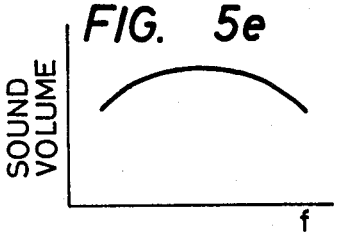

FIG. 4*e* shows the construction of this invention. The curved type piezoelectric ceramic plate 5 is snugly fitted in an organic high-polymer resin frame 7. (The plate 5 may well be bonded to the frame 7 in only its end part.) During operation, the plate 5 can move in the vertical or amplitude direction and can also bend and stretch in the direction of the plane thereof. This is based on the fact that the relative rigidity of the organic high-polymer resin is $0.1\times10^7$–$0.5\times10^7$ N·m/kg (where N denotes the Newton constant) or less and is one order smaller than those of ordinary metals. That is, the resin frame is flexible to a mechanical force and is rich in elasticity while possessing the function of holding the plate. FIG. 5*e* shows the corresponding frequency band. The flat frequency band is attained over 0.1–5 kHz, and is sufficient for producing voices.

EXAMPLE 1

Figure 6A:
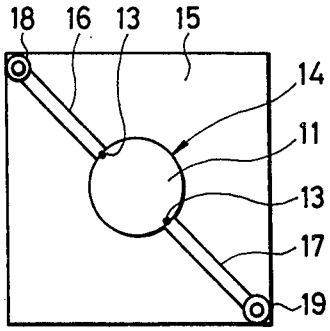
FIGS. 6*a* and 6*b* are a plan view and a sectional view of a transducer embodying this invention, respectively.
Figure 6B:
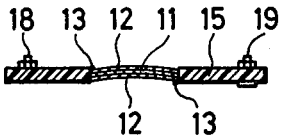

FIGS. 6*a* and 6*b* are a schematic plan view and a sectional view of a transducer which is an embodiment of this invention, respectively.

A piezoelectric disc made of a $Pb(ZrTi)O_3$ type transparent piezoelectric ceramic and having a diameter of 27 mm and a thickness of 0.2 mm was prepared. Both the main surfaces of the transparent piezoelectric ceramic disc 11 were coated with transparent electrodes 12. Using the electrodes, the polarization treatment of applying a high D.C. voltage was performed. A transparent plate of polycarbonate 15 which was in the shape of a square with one side being 150 mm and which was 1.5 mm thick was prepared. A hole 14 having a diameter of 16.95 mm was provided in the central part of the plate 15. The transparent ceramic disc 11 was fitted in the hole 14, and was held in the curved surface state in which the radius of curvature R became 200–150 mm.

Both the front and rear surfaces of the square plate of polycarbonate were coated with transparent films 16 and 17 along the diagonal lines instead of leads, and the films 16 and 17 were respectively connected to terminals 18 and 19. The end parts of the transparent leads 16 and 17 facing the hole 14 were coated with a silver paste 13 so as to electrically couple the transparent piezoelectric plate 11 and the electrodes 12. The transducer thus finished up could radiate a rich sound volume as a loudspeaker when an audio signal was applied across the terminals 18 and 19.

While the feature of this embodiment is that the transparent flat loudspeaker has been realized, another feature resides in the function of the vibrator of the sound producing portion. More specifically, since the holding plate of polycarbonate 15 holds the vibrator plate 11 in the curved state, the edge surrounding the hole 14 is distorted under a considerable compressive force. Therefore, when the vibrator plate 11 vibrates to execute a bending deformation, also the holding plate 15 vibrates as the reaction and gives forth a sound from its plane. This is the feature of the present embodiment, and a sound of a high frequency component is produced from the vibrator plate 11, while a sound of a low frequency component is produced from the portion of the holding plate 15. In terms of the functions of the loudspeaker, the portion of the vibrator plate 11 functions as a tweeter and the portion of the holding plate 15 as a woofer. As a result, the frequency response of the output is of a wide band, which has been confirmed to extend from 50 Hz to 10 kHz or more. This is a favorable result which has not been achieved with known flat loudspeakers.

While, in the above example, polycarbonate was used for the holding frame 15, it is not restrictive, but other organic high-polymer resins can be used. Usable were a wide range of materials including, for example, acrylic resin, foamed resin such as foamed polystyrene, hard polyvinyl chloride, and phenol-formaldehyde resin. Further, phosphor bronze could be used.

The above embodiment concerns the transducer itself, and a characteristic case will also be referred to in relation to the usage thereof.

EXAMPLE 2

Figure 7:
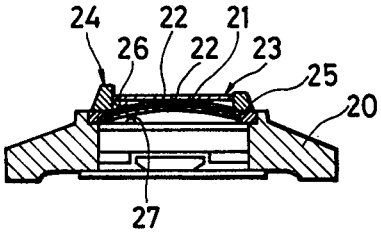
FIG. 7 is a sectional view of another embodiment.

FIG. 7 is a schematic sectional view of a transducer which is another embodiment of this invention.

The same vibrator 21 as used in Example 1 was installed on a polycarbonate member having the same nature as in Example 1. In the present example, the polycarbonate member was not a plate but was a ring-shaped frame 25 having an outside diameter of 33 mm, an inside diameter of 26.95 mm and a thickness of 1.5 mm as shown in FIG. 7. The vibrator 21 was held in the ring 25 so as to form a curved surface of R=200−150 mm, and springs 26 and 27 were held in contact with the surfaces of transparent electrodes 22 of the vibrator 21. The ring 25 was mounted in a metal case 20 of a wrist watch, and a stainless steel ring 24 with a transparent protective plate 23 stuck thereto was fixed on the ring 25. The spring 26 was grounded to the case 20 through the stainless steel ring 24. The spring 27 was connected to an input terminal of an amplifier and an output of a speech synthesis circuit through a change-over switch. When the output of the speech synthesis circuit was actuated, the vibrator 21 performed the sound of a chime or announced the present time in a short speech such as "It is —(o'clock)—(minutes)". When the change-over switch was thrown to the amplifier, the transducer turned into a microphone and was confirmed to operate as a wireless microphone.

Since the transparent transducer serves also as a display window, the occupying space is small, which is favorable for micro devices.

EXAMPLE 3

Figure 8:
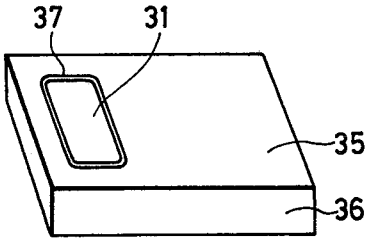
FIGS. 8 and 9 are perspective views of different embodiments.

FIG. 8 is a schematic perspective view of a transducer which is still another embodiment of this invention.

A $Pb(ZrTi)O_3$ type transparent ceramic plate was molded into a rectangular plate 31 which was 20 mm wide, 40 mm long and 0.2 mm thick. It was coated with transparent electrodes and was polarized to form a piezoelectric plate. This piezoelectric plate was put into a curved surface forming a radius of cuvature of 200−150 mm, and was fitted in and held by a polycarbonate plate 35 which was 100 mm long, 70 mm wide and 1.5 mm thick. The resultant plate 35 was put on and fixed to a box 36 which was separately prepared, which was made of polycarbonate and which had dimensions of 100 mm×70 mm×15 mm. Inside the box, an audio equipment such as radio and tape recorder could be received. When an input was applied across the transparent electrodes, the vibrator 31 operated as a loudspeaker while a frame 37 was also vibrating. Since the box 36 functioned as a resonant chamber, a considerable sound volume was attained.

EXAMPLE 4

Figure 9:
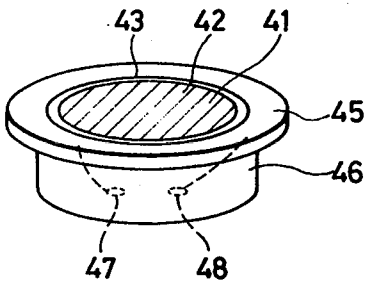

FIG. 9 is a schematic perspective view of a transducer which is still another embodiment of this invention.

As in the case of Example 2, a piezoelectric ceramic vibrator 41 in which both the main surfaces of a $Pb(ZrTi)O_3$ type ceramic disc having a diameter of 40 mm and a thickness of 0.2 mm were provided with silver electrodes 42 was fitted in a ring of polycarbonate 45 having an outside diameter of 50 mm, an inside diameter of 39.90 mm and a thickness of 2 mm and was held in the shape of a curved surface having a radius of curvature of R=200−105 mm. The vibrator plate 41 was fixed by the use of a metallic O-ring 43 having a thickness of 0.5 mm and an outside diameter of 40 mm. Since the O-ring 43 was electrically connected with the electrodes 42 of the vibrator 41, it had leads soldered thereto. The ends of the leads remote from the O-ring 43 were respectively connected to terminals 47 and 48 which were fixed to a bottom plate of a cylinder 46 bonded with the ring 45.

Thus, the transducer for an open space was finished up. When the transducer was received in the cases of a headphone, a handset of telephone, etc. with its terminals 47 and 48 connected to predetermined circuits, it was suited to the respective uses. In the applications to the headphone, the handset etc., the opening of the transducer case was covered with the ear, so that the vibrator became easy of matching the acoustic impedance and that both the sensitivity and the sound quality became favorable. In the application to the headphone, when a signal of 1.5 V was applied, a sound in an excessive volume reached the ear. In the application to the mouthpiece of the handset, the transducer was in a half-open space state, so that it became high in sensitivity and could be simultaneously protected from external noise. The transducer, however, had to be received in the case with oscillations from this case prevented sufficiently.

In the above, the transducers of this invention have been described in connection with the embodiments. They have such basic features 1. that they are applicable to both a transmitter (mouthpiece) and a receiver (earpiece), 2. that they can be constructed to be very thin, 3. that they are structurally simple, and 4. that they have a high electroacoustic conversion efficiency.

EXAMPLE 5

The requisite of the transducer of this invention is that a piezoelectric ceramic plate is held in the shape of a curved surface. The curved surface can be obtained by applying or combining well-known techniques, for example, by employing a method in which the ceramic plate is narrowed and pressed at the room temperature or a high temperature with spherical molds, whereupon it is fixed with a binder to leave the curved deformation behind in the ceramic. At this time, the shape of the ceramic plate may be any desired shape such as a circle, ellipse, square, rectangle, and polygon.

Leads are connected to electrodes on both the front and rear main surfaces of the piezoelectric ceramic deformed into the curve, and an audio electric signal is applied to the electrodes. Since the perimetric edge of the piezoelectric ceramic flat plate can be fixed with the binder merely by deforming the ceramic plate into the curve, a vibrating motion perpendicular to the plane of the plate can be produced, and an audio transducer is provided.

It is important that the piezoelectric ceramic transducer deformed into the curve is fixed to a frame formed with a hole whose shape is substantially similar to the external shape of the transducer and whose size is smaller than the size of the transducer. Since the size of the hole is smaller than the ceramic plate, the perimetric edge of the ceramic plate can be put on the frame in the state in which it protrudes outside the hole uniformly. This brings forth the advantage that the perimetric edge of the ceramic plate can be readily fixed to the frame with the binder. The ceramic plate fabricated by such method can hold the curved deformation stably and permanently owing to the fixation to the frame. Moreover, since the ceramic plate is constrained by the bore of the frame so as to be difficult of changing its outside diameter, it causes the bending vibration more greatly to that extent than a curved plate with a free perimetric edge when the audio signal is applied. As a result, the radiation sound volume of the transducer increases.

This applies, not only to the loudspeaker, but also to a case of employing the transducer as, e.g., a microphone for converting a sound into an electric signal. Accordingly, although the transducer will be hereinbelow described of only a loudspeaker for the sake of brevity, no restriction is intended.

When the audio signal is applied to the ceramic plate to expand and contract the latter, the outer perimeter of the plate intends to change simultaneously, but the plate is fixed to the frame as described previously. When the size of the frame plate is selected to be sufficiently larger than that of the ceramic plate, the frame plate shows a satisfactory response to a signal of low frequency. That is, when the piezoelectric ceramic plate deformed into the curve is fixed to the frame plate having a sufficiently large area, a transducer of good low-pitched sound responsibility can be constructed, and the sound quality can be improved. Accordingly, the holding plate should better be made sufficiently large in order to hold the ceramic plate satisfactorily in the mechanical point and also to render the speech characteristic good.

Here, it is not easy to realize a residual deformation at high precision by curving the ceramic flat plate. The reasons are that jigs of high precision are required, and that when the radius of curvature of the curve is large, the deformation does not remain, whereas when the radius of curvature is small, the plate is easy of deformation but is prone to crack. Moreover, a transducer holding a stable shape which has a large radius of curvature and which is barely seen to be curved is higher in the electroacoustic conversion efficiency than a transducer which is deformed into a too small radius of curvature so skilfully as to be going to crack. It is therefore favorable that the ceramic plate is deformed slightly and reliably.

As a concrete expedient for realizing such ceramic plate, by way of example, a frame plate which is provided with a hole smaller than the external shape of the ceramic flat plate is placed on a spherical convex base, and a heavy ring which has a concave surface mating with the convex surface of the base is placed as a weight from above the frame plate. Then, the frame plate is deformed to be convex, and the size of the hole is enlarged. In the state in which the hole is enlarged, the upper surface of the frame plate and the lower surface of the ceramic plate which correspond to the perimetric edge of the hole are bonded. After the binder has hardened, the frame is gently detached from the convex base and has its warp straightened into a flat surface. Thus, the ceramic plate is readily endowed with a convex deformation with its bonded surface located inside. Hereunder, the example will be concretely described.

Figure 10:
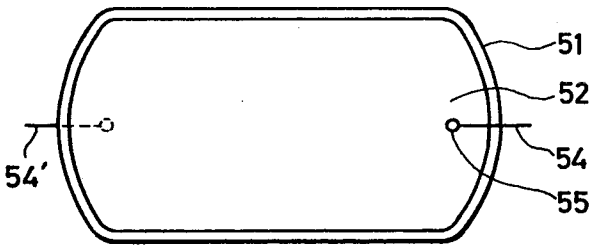
FIG. 10 is a plan view of a piezoelectric ceramic plate provided with electrodes.

As shown in a plan view of FIG. 10, a convex piezoelectric ceramic transducer employed as its starting material a piezoelectric ceramic represented by a $Pb(ZrTi)O_3$ type ceramic or a transparent piezoelectric ceramic represented by $Pb_{1-x}La_x(Zr_{1-y}Ti_y)_{1-x/4}O_3$ as indicated by numeral 51, and the starting material was formed into a thin flat ceramic plate which had a thickness of about 0.1–0.5 mm, an area of about 200–10,000 $mm^2$ and an area-to-thickness ratio of about 2,000–20,000 mm. In accordance with a purpose, the shape of the thin plate may be any desired one such as a circle, ellipse, square, rectangle and polygon. Electrodes 52 were disposed on both the main surfaces of the thin plate 51 by such a method as baking of silver, metal evaporation, sputtering, plating, spraying and coating. According to the purpose, the electrodes are applicable in various aspects including a lusterless state as in the silver baking, a state having metal luster as in a plated film, a transparent state as in a transparent electrode film of $In_2O_3$-$SnO_2$, etc. However, it was desirable for the transducer of the present invention that thin electrode films were securely deposited, and it was more convenient that the electrodes had portions 55 to which leads 54 and 54' could be directly soldered.

Subsequently, a polarization treatment was carried out by applying a high D.C. voltage across the two, front and rear electrodes. A piezoelectricity develops owing to the polarization treatment. The conditions of the treatment are peculiar to respective materials, and the peculiar optimum conditions may be conformed with. In general, however, a high D.C. voltage of approximately 20–40 kV/cm is applied in a high-temperature atmosphere of approximately 80° C. (insulating oil is sometimes used) for 30 minutes or more. The polarized piezoelectric ceramic flat plate was bonded and fixed to a predetermined holding plate, to be endowed with a spherically curved deformation. Then, the transducer was obtained.

Another method of forming the curved surface will now be described.

Figure 11:
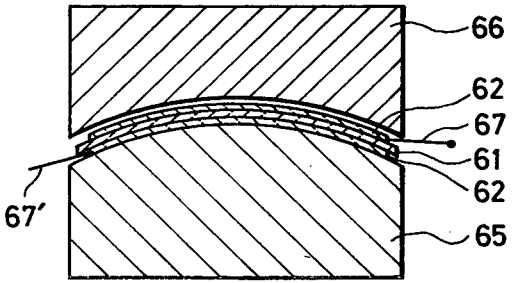

As illustrated in FIG. 11, the polarized piezoelectric ceramic thin plate 61 described above was sandwiched between a convex spherical jig 65 having a radius of curvature of about 400 mm and a concave jig 66 having the same curvature so as to be deformed into the shape of a convex plate. Numerals 62 indicate electrodes which were disposed on the piezoelectric ceramic plate 61, and numerals 67 and 67' leads which were attached to the electrodes 62. Here, when the radius of curvature is great, no deformation is left behind, whereas when the radius is small, the ceramic is prone to crack. Pressing at a high temperature is effective for establishing a stable deformation. The ceramic plate to be treated in this case is that having been provided with the electrodes by the foregoing method and not being polarized yet. When the ceramic plate having been polarized is subjected to the high-temperature pressing, the polarization disappears and a re-polarizing operation is needed.

Jigs having the same spheres as in the foregoing were made of stainless steel, and the ceramic plate with the electrodes was sandwiched therebetween and was heated to above the Curie point of the starting material. After the ceramic plate was held at or above the Curie point for a while, it was cooled slowly. After the temperature of the ceramic plate became lower than 100° C., the plate was slowly cooled while applying a D.C. electric field at an intensity of approximately 20–40 kV/cm across the electrodes. Then, the polarization treatment could be performed simultaneously with the formation of the curved deformation.

EXAMPLE 6

Even when a ceramic having a great electrostriction effect is utilized, quite the same result is achieved. Hereunder, reference will be had to FIGS. 12, 13 and 14.

Figure 12:
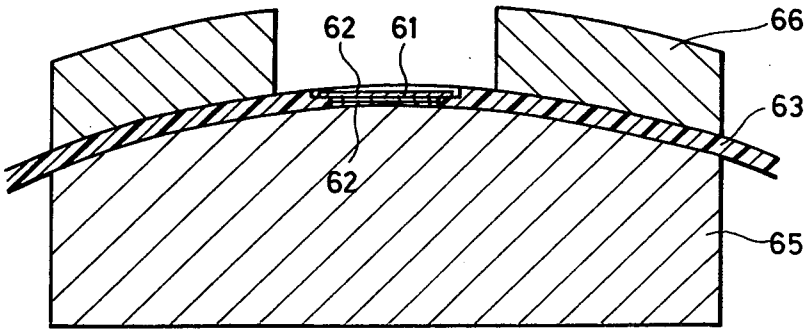
FIGS. 11 to 13 are explanatory views showing a method of forming curved surfaces.
Figure 13:
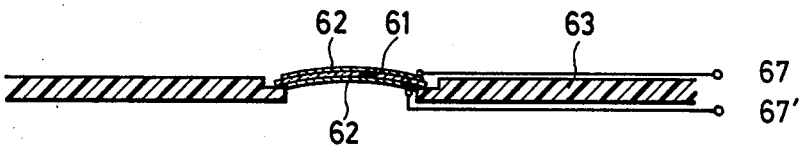
Figure 14:
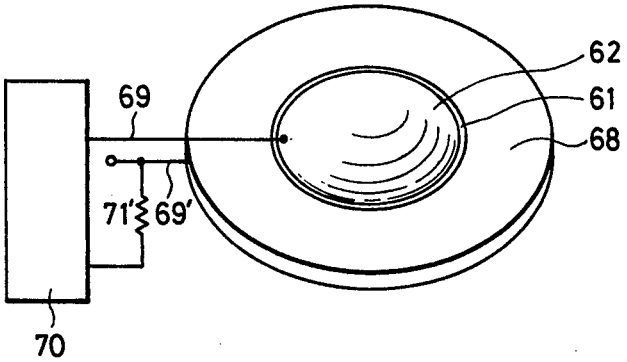
FIG. 14 is an explanatory view showing another embodiment of this invention.

Used here was a $Pb(Mg_{\frac{1}{3}}Nb_{\frac{2}{3}})O_3$-$PbTiO_3$ type ceramic, which had the same shape as in the device of Example 5, which was similarly provided with electrodes 62 and which was formed into a disc element 61 having a thickness of 0.1 mm and a diameter of 30 mm. Since an electrostriction device need not be subjected to a polarization treatment, the disc element was securely bonded to a doughnut-shaped ring 63 of a polycarbonate plate having a diameter of 50 mm and a thickness of 1.5 mm and provided with a concentric circular hole of a diameter of 25 mm, by the same method as in Example 5 and with an epoxy type binder. At this time, the ring 63 was sandwiched between a convex spherical jig 65 and a concave spherical deformable ring jig 66 as shown in FIG. 12 and was held in the state in which the hole of the diameter of 25 mm was expanded. Under this state, the electrostriction element 61 was bonded and fixed to the ring 63. Accordingly, at the same time that the polycarbonate ring 63 having been deformed into a convex plate was returned to the flat plate by removing the concave spherical jig 66, the electrostrictive ceramic 61 caused a convex deformation, and an acoustic transducer was finished up. FIG. 13 is a sectional view showing this state. Leads 69 and 69' were soldered to the electrodes 62 on both the main surfaces, and the lead 69 was connected to a power supply 70 and the lead 69' to a load resistor 71.

When a sound is applied to the transducer, the curvature of the convex surface changes in accordance with the amplitude of the sound. Therefore, a tension which keeps the transducer curved changes, and the electric capacitance of the transducer changes responsively. From the viewpoint of an equivalent circuit, the capacitance of a capacitor to which a bias voltage is applied from the power supply 70 changes according to the vibration of the sound, so that current flows through the load resistor 71. When a potential difference based on a voltage drop across the resistor 71 is amplified, an electrical output responsive to the acoustic signal is provided. It has been proved that the transducer is useful as a microphone of high sensitivity and high quality.

When the power supply was changed from a D.C. source to a constant-voltage source of A.C. signals of at least 100 kHz, an output modulated by speech was provided. When an audio signal component was detected, an output of high quality distorted less than in the case of the D.C. source was provided.

EXAMPLE 7

Figure 15:
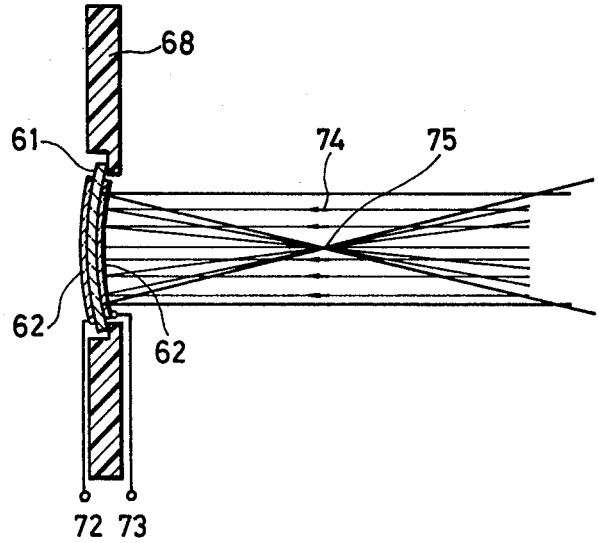
FIG. 15 is a sectional view for explaining the manufacturing process of the embodiment in FIG. 14.

An electrostriction transducer 61 employing a $Pb(Mg_{\frac{1}{3}}Nb_{\frac{2}{3}})O_3$-$PbTiO_3$ type ceramic and fabricated by the same method as in Example 6 was similarly bonded to a doughnut-shaped polycarbonate ring 68 having a diameter of 50 mm, an inside diameter of 25 mm and a thickness of 1.5 mm, thereby to be deformed into the shape of a convex surface. The surfaces of the electrostrictive ceramic were mirror-polished and had aluminum evaporated thereon so as to serve both as a mirror and as electrodes. Leads 72 and 73 were bonded to the electrodes. Then, a voltage-variable focus mirror shown in FIG. 15 was fabricated.

When a collimated beam 74 of a laser was projected onto the inner side of the transducer, the laser beam was focused at a position 75 which was about 400 mm ahead of the transducer. When, under this state, a D.C. voltage of 100 volts was applied across the leads 72 and 73, the focal distance shortened to about 150 mm. The variation of the focal distance versus the magnitude of the voltage was not rectilinear, but was of a quadratic curve. However, the mirror had the merit that the relationship between the value of the applied voltage and the focal distance was uniquely determined. Plots measured while raising the voltage and plots measured while lowering it agreed well, and no hysteresis phenomenon was observed. It has been revealed that when the stability of the applied voltage is ensured satisfactorily, the variation of the focal distance can be controlled extraordinarily accurately.

According to this invention, since the external shape of the ceramic transducer can be selected at will, there is the effect that a desired vibration mode can be set. In addition, since the shape of the fixing portion of the frame to fix the transducer need not be made exactly similar to the external shape of the transducer, there is the effect that machining of high precision is not necessary and that low cost and mass production are permitted. Further, according to this invention, the ceramic transducer has not its deformation restrained perfectly by the frame member but has its shape kept by the balance between the forces of the transducer and the frame. This brings forth the merit that the frame can be induced to vibrate simultaneously with the vibration of the transducer, resulting in the effect that the sound range of vibrations spreads and that the sound volume increases. Especially when fixed to the frame plate of large area, the transducer is effective to improve the sound range and the sound volume.

What is claimed is:

1. A transducer comprising at least a piezoelectric plate which has two main surfaces comprising curved surfaces, with edges of the piezoelectric plate adjoining to and extending between the two main surfaces, electrodes formed on the two main surfaces of said piezoelectric plate, a frame which is attached to said edges of said piezoelectric plate, said frame being attached to the plate only at said edges, with only said frame holding said plate, and which frame is made of a material having a relative rigidity of $0.5\times10^7$ N·m/Kg or less.

2. A transducer according to claim 1, wherein said frame is in the shape of a flat plate which has an opening or a recess in its central part.

3. A transducer according to claim 2, wherein said piezoelectric plate is made of a transparent ceramic material.

4. A transducer according to claim 2, wherein said frame is made of a member selected from the group consisting of polycarbonate, acrylic resin, polystyrene, hard polyvinyl chloride and phenol-formaldehyde.

5. A transducer according to claim 1, wherein said piezoelectric plate is made of a transparent ceramic material.

6. A transducer according to claim 1, wherein said frame is made of an organic high-polymer resin.

7. A transducer according to claim 6, wherein said piezoelectric plate is held in a curved state by said frame.

8. A transducer according to claim 6, wherein said piezoelectric plate has deformed surfaces when attached in said frame.

9. A transducer according to claim 8, wherein the perimetric edge of said piezoelectric plate which has said deformed surfaces is fixed with a binder.

10. A transducer according to claim 6, wherein said transducer has dimensions whereby the transducer can be used for an audio frequency electro-acoustic transducer.

11. A transducer according to claim 6, wherein said frame has an opening or recess for attachment to the edges of said piezoelectric plate, said opening or recess having a shape substantially similar to the external shape of the transducer and whose size is smaller than the size of the transducer.

12. A transducer according to claim 1, wherein said piezoelectric plate is held in a curved state by said frame.

13. A transducer according to claim 1, wherein said piezoelectric plate has deformed surfaces when attached in said frame.

14. A transducer according to claim 13, wherein the perimetric edge of said piezoelectric plate which has said deformed surfaces is fixed with a binder.

15. A transducer according to claim 1, wherein said transducer has dimensions whereby the transducer can be used for an audio frequency electro-acoustic transducer.

16. A transducer according to claim 1, wherein the radius of curvature of said curved surfaces is 100–1000 mm.

17. A transducer according to claim 1, wherein said relative rigidity is $0.1\times10^7$–$0.5\times10^7$ N·m/Kg.

18. A transducer according to claim 1, wherein said frame has an opening or recess for attachment to the edges of said piezoelectric plate, said opening or recess having a shape substantially similar to the external shape of the transducer and whose size is smaller than the size of the transducer.

19. A transducer according to claim 1, wherein said transducer consists essentially of said piezoelectric plate and said frame.

20. A transducer comprising at least a piezoelectric plate which has two main surfaces comprising curved surfaces, with edges of the piezoelectric plate adjoining to and extending between the two main surfaces, electrodes formed on the two main surfaces of said piezoelectric plate, a frame which is attached to said edges of said piezoelectric plate, said frame being attached to the plate only at said edges, with only said frame holding said plate, and which frame is made of a material that, when formed into said frame, can hold the piezoelectric plate, is flexible and is elastic.

21. A transducer according to claim 20, wherein the frame is made of an organic high-polymer resin.

* * * * *